US007190802B2

(12) United States Patent
Rains et al.

(10) Patent No.: US 7,190,802 B2
(45) Date of Patent: Mar. 13, 2007

(54) MICROPHONE ENCLOSURE FOR REDUCING ACOUSTICAL INTERFERENCE

(75) Inventors: William A. Rains, Santa Cruz, CA (US); Arun Mirchandani, Pleasanton, CA (US); Robert E. Shostak, Portola Valley, CA (US); Chris Wheaton, San Francisco, CA (US)

(73) Assignee: Vocera Communications, Inc., Cupertino, CA (US)

( * ) Notice: Subject to any disclaimer, the term of this patent is extended or adjusted under 35 U.S.C. 154(b) by 494 days.

(21) Appl. No.: 10/231,733

(22) Filed: Aug. 30, 2002

(65) Prior Publication Data

US 2004/0042630 A1 Mar. 4, 2004

(51) Int. Cl.
*H04R 25/00* (2006.01)

(52) U.S. Cl. ..... 381/369; 381/355; 381/361; 381/365

(58) Field of Classification Search ..... 381/313, 381/357, 364, 92, 177, 355, 360, 361, 369, 381/368, 365, 324, 356, 358; 379/428.01, 379/433.01, 433.03, 440; 455/90.3, 575.1, 455/550.1

See application file for complete search history.

(56) References Cited

U.S. PATENT DOCUMENTS 5,042,071 A * 8/1991 Stinauer et al. ..... 381/368
5,204,907 A * 4/1993 Staple et al. ..... 381/91
5,263,093 A * 11/1993 Nakamura et al. ..... 381/357
6,570,992 B1 * 5/2003 Folan et al. ..... 381/365

* cited by examiner

*Primary Examiner*—Curtis Kuntz
*Assistant Examiner*—Tuan Duc Nguyen
(74) *Attorney, Agent, or Firm*—DLA Piper US LLP

(57) ABSTRACT

A microphone enclosure for reducing the intensity of sound waves that reach a microphone is presented. The enclosure may be a solid mass with a cavity, designed so that most of the microphone is surrounded by the solid mass when the microphone is inserted into the cavity. The solid mass is dense enough to reduce much of the sound waves that are first mechanically and then acoustically coupled with the microphone. The microphone may be inserted into the cavity so that a sound receiving section is exposed at the entrance of the cavity. Also, the microphone may not be inserted to the end of the cavity so that there is a space between the end of the cavity and the microphone. A hole may be located on the cavity sidewall so that sound can reach the microphone through this space. The sound receiving sections of the microphone are aligned with openings in the communications device.

15 Claims, 6 Drawing Sheets

(SECTION A-A)

MICROPHONE ENCLOSURE FOR REDUCING ACOUSTICAL INTERFERENCE

BACKGROUND OF THE INVENTION

The invention pertains generally to a system and method for providing wireless communication between individuals and in particular to audio communication.

While audio communication has become a common form of communication, new challenges are posed by the fact that the devices for audio communication are becoming increasingly small. For example, when a audio communication device is small, the microphone and the speaker cannot be placed far apart. Thus, when the microphone is physically close to a speaker in a full-duplex system, the voice of an individual received through the speaker may feed back into the microphone and cause the talker to hear himself like an acoustic echo even though the talker is talking at an appropriate volume level.

Sound waves travel from the speaker to the microphone in two ways: mechanically and acoustically. The transmission of sound to the microphone may occur at least partly mechanically due to vibration of various physical components around the speaker, such as the housing or a printed circuit board. The energy of the sound waves propagates through the physical components until when mechanical-acoustic coupling occurs and the mechanical energy converts into acoustic energy coming off the surface of the vibrating physical component. This energy off the surface of the physical component travels through air in a purely acoustical manner to be coupled with the microphone.

The mechanical vibration may be reduced by placing foam or a rubbery material around the microphone, thereby decoupling the microphone from the purely mechanical vibrations. However, the foam or the rubbery material does not reduce the acoustic transmission of sound waves from the speaker to the microphone. When loud enough sounds are output from the speaker, the sound energy mechanically output from the rear side of the speaker may stay inside the housing, experience mechanical-acoustic coupling, and travel via an effective acoustic passage to the microphone regardless of the presence of the foam material. When the speaker and the microphone are placed in a small device, this problem become more prominent than in a large device due to the proximity of the two components and the thinness of the device walls (for lighter weight).

Therefore, as communication devices become increasingly smaller and lighter, new methods of controlling the coupling of speaker sound energy to a microphone become necessary. Some solutions that would have once been considered obvious, such as placing the microphone and the speaker sufficiently far apart to prevent this type of unwanted sound coupling, is not a viable solution for small, handheld voice communication devices. The problem is compounded by the fact that small communication devices often use thin plastic housing in order to make the device as light as possible. Devices housed in thin plastic tend to be especially vulnerable to acoustic transmission because vibration of the thin housing walls create acoustic waves, in a similar way that drumheads generate sounds. Thickening the housing walls solves the acoustic transmission problem but has the "side effect" of increased device weight.

A method and apparatus for reducing sound transmission from a speaker to a nearby microphone with minimal extra volume and weight are desired.

SUMMARY OF THE INVENTION

A microphone enclosure for reducing the intensity of sound waves that reach a microphone is presented. The enclosure may be a solid mass with a cavity into which the microphone can be inserted. When the microphone is placed in the cavity, most of the microphone is surrounded by the solid mass dense enough to eliminate or at least reduce the mechanical-acoustic coupling of much of the sound waves. The microphone enclosure is designed so that it does not cover the sound receiving sections of the microphone. For example, the microphone may be inserted into the cavity so that a sound receiving section is exposed at the entrance of the cavity. Also, the cavity may be designed so that the microphone cannot be inserted all the way in, for example by making the deeper part of the cavity narrower than the width of the microphone. This way, there is a space between the end/bottom of the cavity and the microphone. A hole may be located on the cavity sidewall so that sound waves can enter this space and reach the microphone.

Preferably, the microphone enclosure is shaped to fill the air space around the microphone in a communication device. Since the microphone enclosure simply replaces the air space around the microphone with a dense material that does not transmit acoustic sound waves as well as air, it does not add extra volume to the device. Further, since the microphone enclosure has to be small enough to fit into the unused space in a small communication device, it is small enough (e.g., approximately 15 mm×8 mm) so that it does not add significant weight to the device. Typically, the microphone enclosure has wire holes so that microphone wires can be extended to parts outside the microphone enclosure.

DETAILED DESCRIPTION OF A PREFERRED EMBODIMENT

The invention is particularly applicable to a small, lightweight full-duplex or near full-duplex wireless communication device. It will be appreciated, however, that the invention has greater utility and can be implemented in any system where sound transmission from a speaker to a microphone is undesirable.

FIGS. 1A–1E depict a hands-free wireless communication device 10 (herein referred to as a "badge") in which the microphone enclosure of the invention may be implemented. Before describing the details of the badge or the different embodiments, a general overview of the badge and its operation will be provided. Each badge is a portable, battery-powered, lightweight, wireless device that serves as the primary communications endpoints of a wireless communication system. The badges support hands-free, near full duplex voice communications using a small microphone (situated near the top of the badge as described below) and a speaker (located near the bottom of the badge as described below).

The badges are sufficiently small and lightweight enough so that the badge may be clipped onto a shirt pocket of the user, may be worn on a lanyard around the neck of a user or carried is a holster similar to cellular phone. In a typical environment with typical noise levels, hands-free operation using voice commands requires the badge to be situated approximately 0.5 meters from the mouth of the user so that the voice commands may be understood by the central computer. Thus, if the badge is carried in a holster, it may need to be removed from the holster and brought closer to the user's mouth for voice command, hands-free operation. For a semi-private conversation or operation in a loud environment with high noise levels, the badge may be inverted (so that the speaker is near the user's ear and the microphone is near the user's mouth) similar to a typical telephone. Optionally, a headphone jack may be provided on the badge. The badge may also include a clip (as described below) that may be used to fasten the badge onto a shirt or shirt pocket or may be used to hold a corporate security badge.

Figure 1C:
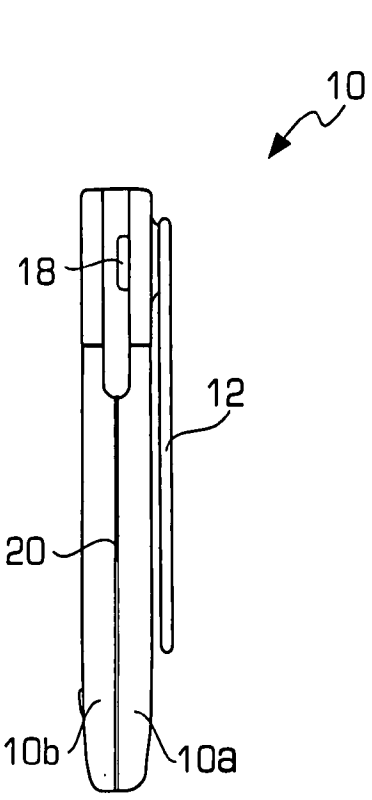
FIG. 1C depicts a side view of the communication device in FIG. 1A.
Figure 1B:
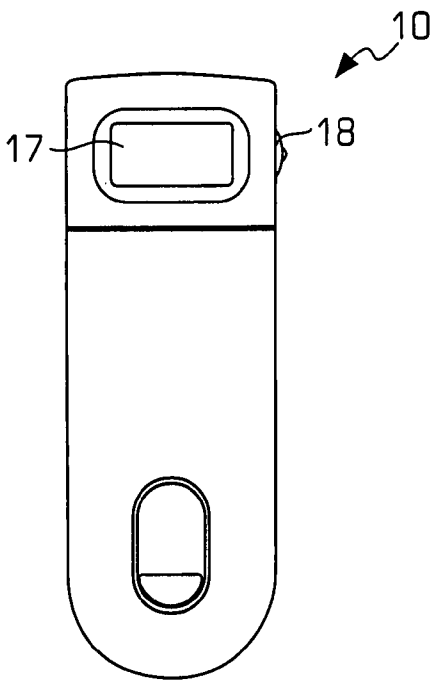
FIG. 1B depicts a back view of the communication device in FIG. 1A.
Figure 1D:
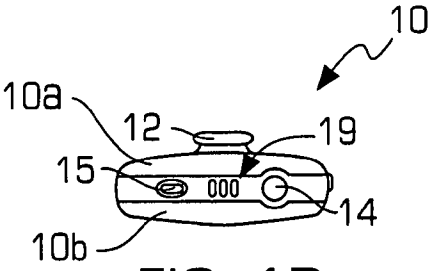
FIG. 1D depicts a top view of the communication device in FIG. 1D.
Figure 1A:
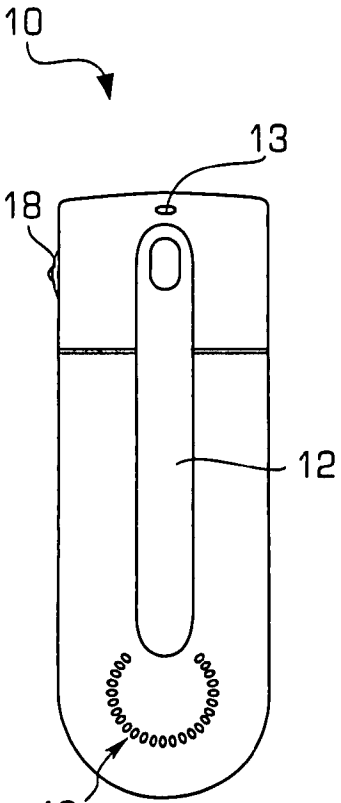
FIG. 1A depicts a front view of an exemplary communication device in which the invention can be implemented.

FIG. 1A depicts the front view of badge 10, which includes a clip 12, a front microphone opening 13 (a top microphone opening 14 is located at the top of badge 10 as shown in FIG. 1D), a speaker opening 16, and an input device 18. The badge 10 includes two microphone openings (13 and 14) because two openings would be necessary if badge 10 were to accommodate a directional microphone. The input device 18 permits the user to control the operation of the badge and its configuration. The back view, depicted in FIG. 1B, shows that badge 10 may also include a display device 17 (e.g., liquid crystal display) that may be used for various purposes such as receiving text messages. FIG. 1C depicts a side view of badge 10. When opened along a line 20, the housing of badge 10 is divided into a front panel 10*a* and a rear panel 10*b*. The front panel 10*a* and the rear panel 10*b* may be made of a thin plastic, such as G. E. Cycoloy C6200 Thermoplastic, to minimize the weight of badge 10. The front panel 10*a* includes clip 12, as shown, and microphone openings 13 and 14 (not shown). FIG. 1D shows badge 10 from the top. This top view shows the top of front panel 10*a*, the top of clip 12 attached thereto, and the top of rear panel 10*b*. In this particular embodiment, a power switch 15, a status indicator 19, and a top microphone opening 14 are located at the top of badge 10. More details about the badge are provided in U.S. patent application Ser. No. 09/947,235, which is incorporated by reference herein in its entirety.

Figure 2:
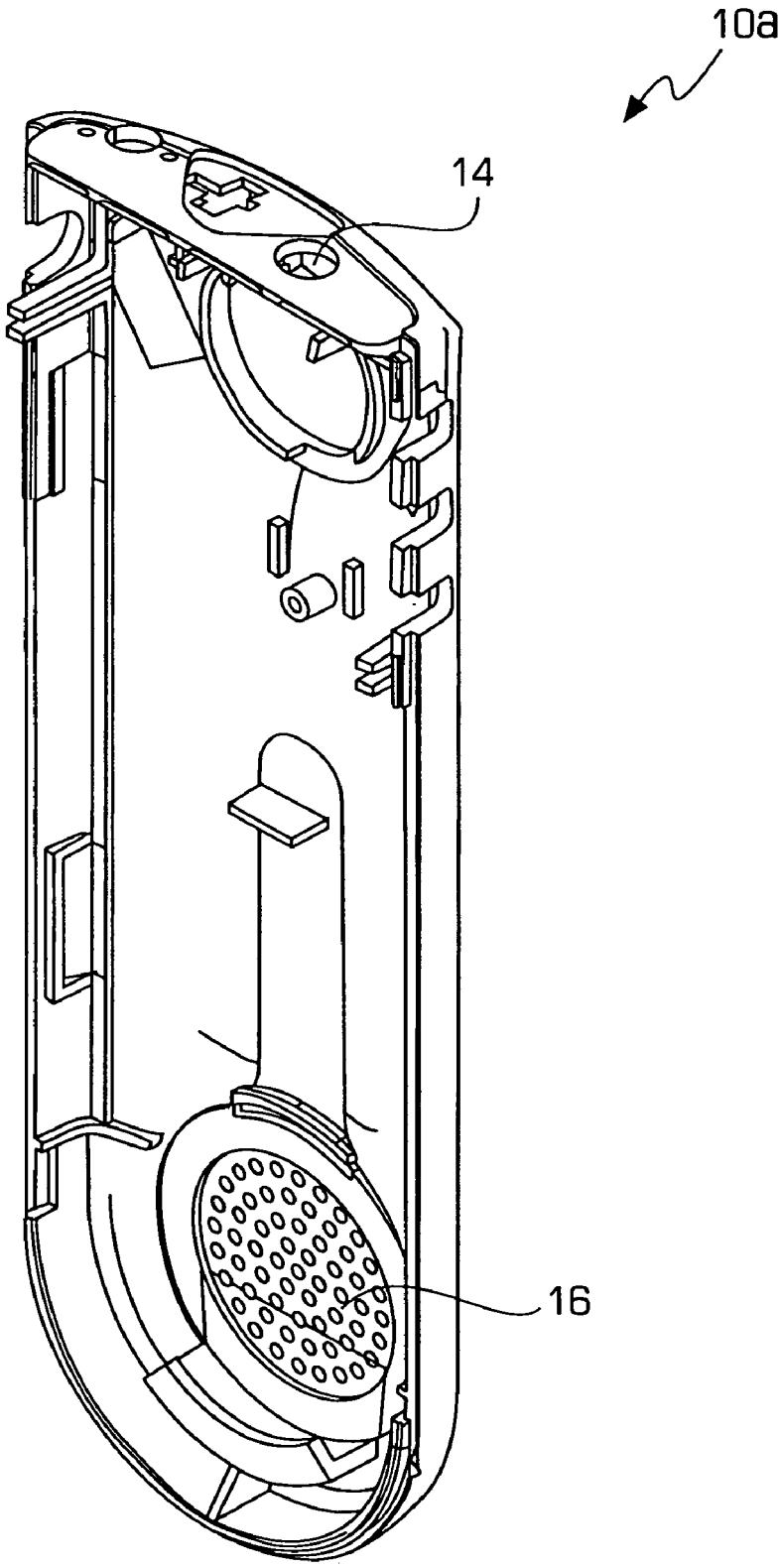
FIG. 2 depicts an exemplary front panel that can be used in the communication device of FIG. 1A.

FIG. 2 depicts the front panel 10*a* of the housing for badge 10 viewed from the inside. The front panel 10*a*, which is designed to accommodate a directional microphone, includes front microphone opening 13 (not shown here; see FIG. 1A), top microphone opening 14 and a speaker opening 16. A microphone is to be placed near the microphone openings 13 and 14 so that the voice of a user can reach the microphone through the microphone openings 13 and 14. Given that badge 10 is small and light, transmission of sound waves from the speaker in the speaker opening 16 to the microphone in the microphone openings 13 and 14 cannot be prevented by simply placing the speaker and the microphone far enough apart.

Figure 3A:
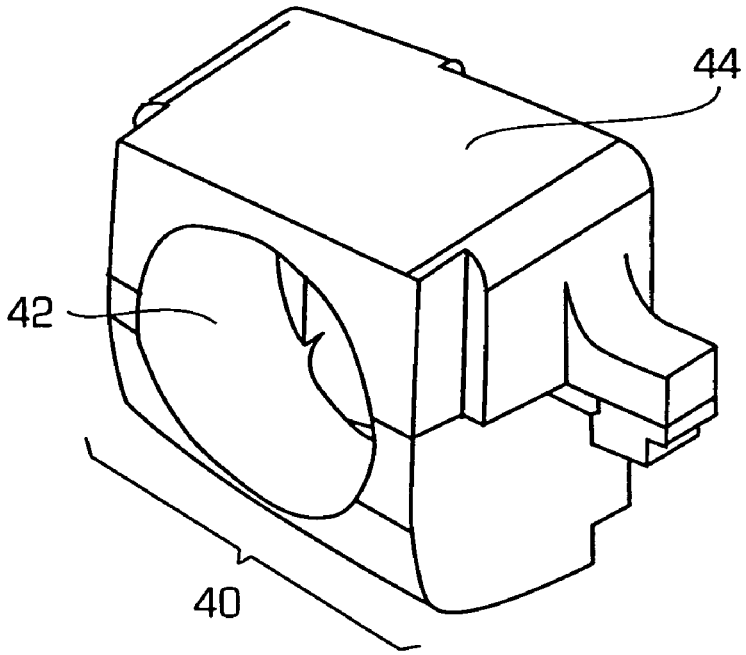
FIG. 3A-FIG. 3E depict an exemplary solid microphone box that can be used to reduce microphone interference in accordance with the invention.

FIG. 3A depicts a perspective view of a microphone box 40 in accordance with the invention for reducing the mechanical-acoustic coupling and hence the intensity of sound waves that reach the microphone (not shown). The microphone box 40 has a solid portion 44 designed to fill much of the air space around the microphone and a cavity 42 in the solid portion 44. The cavity 42 is sized to tightly fit a microphone and a microphone boot that are together placed in cavity 42. The shape and the dimensions of microphone box 40 are dictated by the size of the microphone, the size of the microphone boot that surrounds the microphone, and the size of badge 10 because microphone box 40 preferably fills as much of the available space around microphone 10 as possible. As for the material, the microphone box 40 may be made of any solid material that is dense enough to eliminate the sound waves from the speaker or at least dramatically reduce the intensity of the sound waves. A person of ordinary skill in the art would understand that certain types of dense plastic may be suitable for microphone box 40.

Figure 3B:
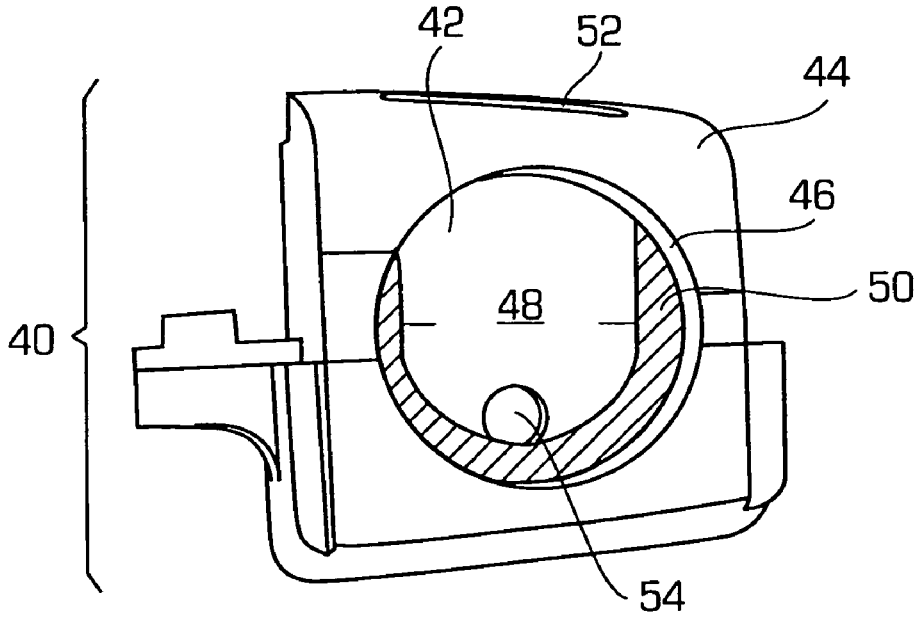
Figure 3C:
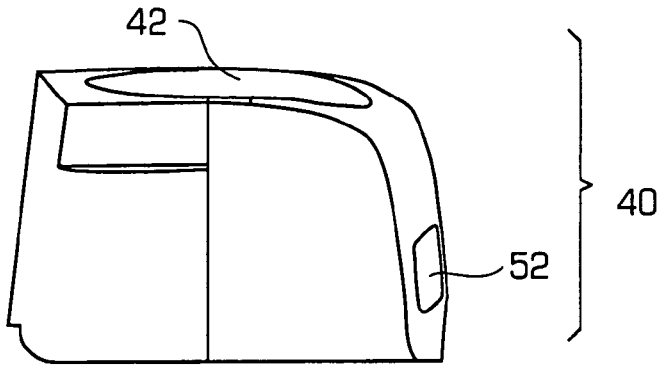

FIG. 3B and FIG. 3C provide a top view and a side view of microphone box 40, respectively. FIG. 3B shows that cavity 42 includes cavity sidewall 46 and cavity bottom 48. The cavity bottom 48 has a wire opening 54 through which microphone wires can extend outside microphone box 40 when the microphone is placed in cavity 42. In addition, there is a shelf 50 (shaded portion) along sidewall 46 on which the microphone is to be lodged. The shelf 50 is designed so that only the edges of the microphone boot around the microphone bottom touches shelf 50, and it is positioned so that the microphone does not touch the cavity bottom 48. Thus, shelf 50 and cavity bottom 48 create a space near the bottom of the microphone. Acoustic waves from a user enter this space through opening 52, which extends from the outer surface of microphone box 40 to cavity sidewall 46, and reach the bottom of the microphone. The opening 52 lines up with the front microphone opening 13 (not shown; see FIG. 1A) so that the voice of the user reaches the microphone bottom. Since the space near the bottom of the microphone is almost entirely surrounded by solid portion 44 except for the side opening 52 and wire opening 54, substantially all acoustic waves from the speaker are blocked and only the voice of the user reaches the microphone through side opening 52. The wire opening 54 is preferably just big enough to extend wires through so that undesired waves do not travel through it and reach the microphone.

Figure 3D:
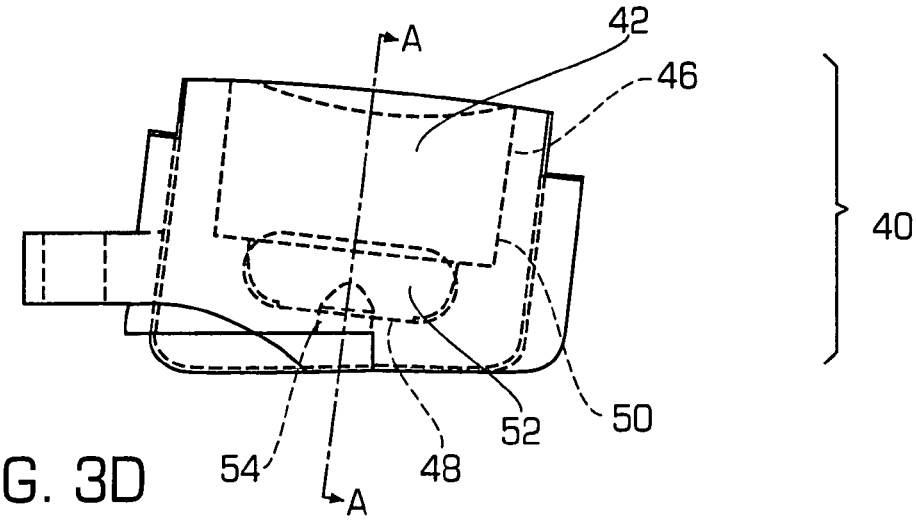

FIG. 3D shows an exemplary set of dimensions for a microphone box 40. The particular microphone box 40 is approximately 15.37 mm wide and approximately 8 mm high. The microphone box 40 is designed in a tilted shape to accommodate the shape of air space inside badge 10 near microphone. The details inside microphone box 40 are shown in dashed lines, which show cavity 42 outlined by sidewall 46, shelf 50, and cavity bottom 48. The cavity bottom 48 is substantially aligned with the bottom of side opening 52 shown as an oval. The wire opening 54, shown as two short parallel lines, extends from cavity bottom 48 to an outer surface of microphone 40.

Figure 3E:
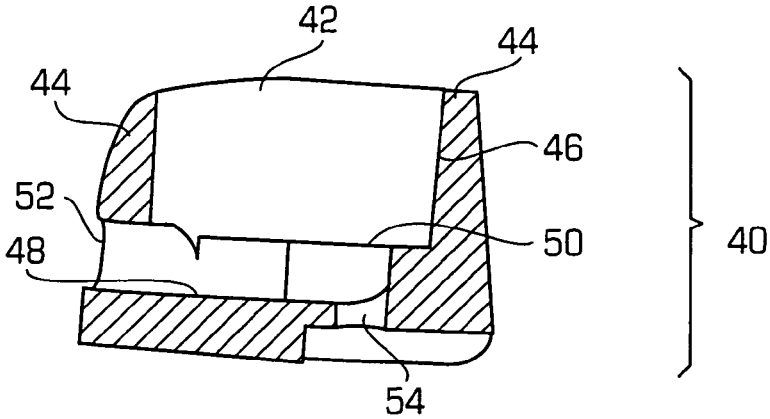

FIG. 3E depicts a cross sectional view of microphone box 40 sliced along the A-A plane shown in FIG. 3D. The shaded areas represent solid plastic that is exactly at the plane of the cross section. The unshaded areas are also solid plastic, but are not at the plane of the cross section. In other words, if microphone box 40 were to be sliced along the plane A—A with a knife, the knife would contact only the shaded portions and cut through air for the unshaded portions. FIG. 3E shows the solid portion 44 surrounding cavity 42, the general shape of which is defined by cavity sidewall 46, shelf 50, and cavity bottom 48. The solid portion 44 to the left side of FIG. 3E has side opening 52 and the cavity bottom 48 has wire opening 54. A person of ordinary skill in the art would understand that the dimensions and the shape of the microphone box, as well as the dimensions and the shape of the cavity 42, may be adjusted to fit a specific application and design environment.

The material that microphone box 40 is made of is preferably thick and dense enough to make the microphone box 40 rigid. The microphone box 40 has no highly resonant vibration modes, due to its rigidity and its odd shape (curved surfaces, lack of parallel outside surfaces). Due to the fact that there is no highly resonant vibration mode, the microphone box 40 does not allow any nearby mechanical energy to be converted into acoustic energy. The microphone box 40 being the only physical component that is in contact with the small amount of air directly around the microphone makes the reduction of mechanical/acoustical coupling especially effective for reducing the overall amount of sound transmitted to the microphone.

Figure 4:
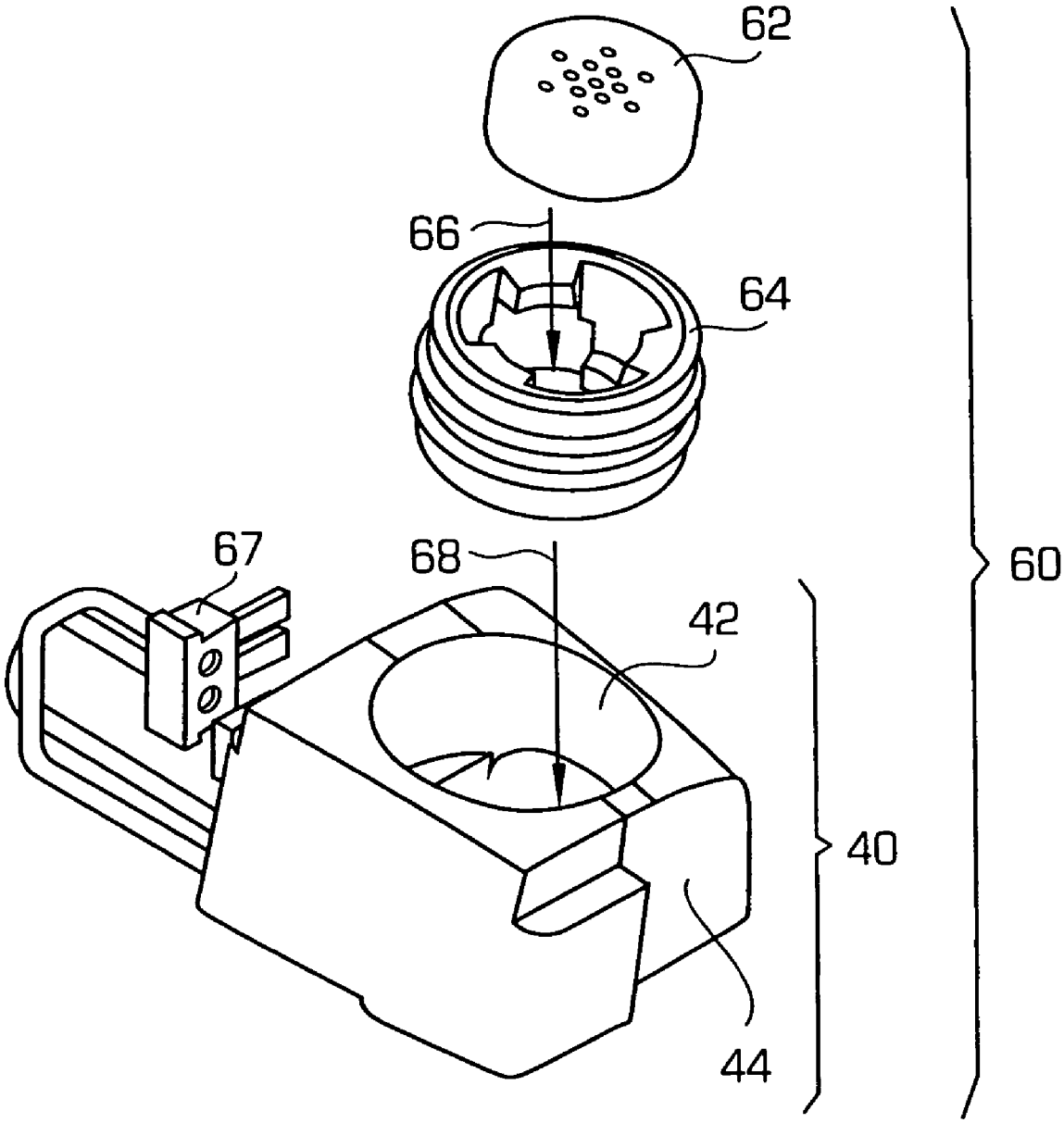
FIG. 4 depicts a method of assembling a microphone and the microphone box of FIG. 3A-FIG. 3E.

FIG. 4 depicts, in a perspective view 60, a method of assembling a microphone 62, a boot 64, and microphone box 40. The microphone 62 is placed inside the boot 64 as shown by an arrow 66. The boot 64, which may be made of a soft-durometer plastic, protects microphone 62 and provides extra physical stability, for example, by preventing microphone 62 from rattling due to vibrations. The boot 64, which acts as a shock absorber for the microphone, provides a mechanically decoupled suspension ant helps reduce any purely-mechanical coupling of sound waves with the microphone. However, there are certain frequencies and modes of vibration that boot 64 does not block effectively. The microphone box 40, however, helps block these frequencies and vibration modes that the boot 64 does not effectively block because it is rigid and thick enough to have sufficient inertia. Although the microphone box 40 alone does not block all the frequencies and vibration modes by itself, the combination of the boot 64 and the microphone box 40 blocks most of the frequencies and vibration modes because the two parts are effective for different frequencies and vibration modes.

The boot 64, which is placed inside cavity 42 as shown by an arrow 68, has an opening at the bottom through which a portion of the microphone wires that is close to the microphone 62 (this portion of the wires is not, shown) can extend into wire opening 54 (see FIG. 3B). Preferably, the boot 64 fits tightly in cavity 42 so that there is minimal amount of air space near microphone 62. As acoustic waves may be created by vibration of physical parts such as front panel 10*a* and air is a good medium for acoustic transmission, boot 64 and solid microphone 40 are preferably designed to minimize the amount of air space between microphone 62 and the physical parts of badge 10 that tend to vibrate from speaker sounds. Solid microphone 40 and boot 64 isolate microphone 62 from acoustic waves by replacing air, a good transmission medium, with a dense, solid transmission barrier. Microphone box 40 may be attached to an electrical circuit through a connector 67.

Figure 5:
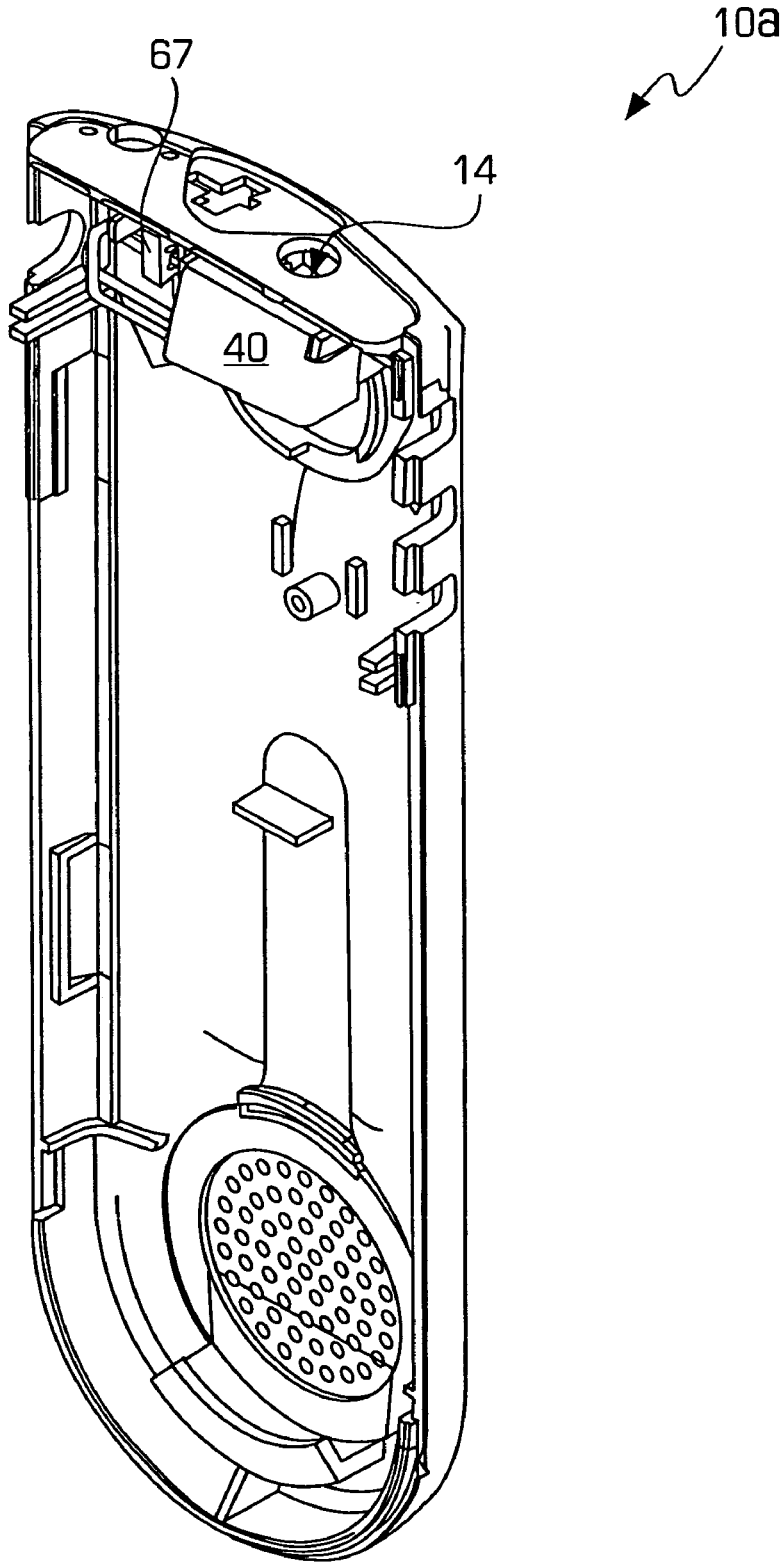
FIG. 5 depicts the microphone box of FIG. 4 placed in the front panel shown in FIG. 2.

FIG. 5 depicts the front panel 10*a* of FIG. 2 with microphone box 40 placed inside. The microphone box 40 holds microphone 62 and boot 64 as shown above in FIG. 4, and should be placed so that cavity 42 is aligned with top microphone opening 14. The side opening 52 (not shown) of microphone box 40 is aligned with front microphone opening 13 (see FIG. 1A) on front panel 10*a*. In the embodiment shown, microphone box 40 is held in place at least partly by being glued to another portion of the device with an adhesive.

While the foregoing has been with reference to a particular embodiment of the invention, it will be appreciated by those skilled in the art that changes in this embodiment may be made without departing from the principles and spirit of the invention, the scope of which is defined by the appended claims.

What is claimed is:

1. A microphone enclosure for reducing the intensity of speaker sound waves that arc coupled with a microphone wherein the microphone and sneaker are connected to a housing, wherein the microphone has a first sound receiving section and a second sound receiving section, the enclosure comprising a solid mass designed to surround the microphone that isolates the microphone from the mechanical vibrations generated by the speaker that are propagated through the housing without covering one or more primary sound receiving sections of the microphone, and a first opening located to allow sound to reach the first sound receiving section and a second opening located to allow sound to reach the second sound receiving section when the microphone is placed in the microphone enclosure.

2. The microphone enclosure of claim 1, wherein the solid mass has a density high enough to significantly reduce the coupling of sound waves with the microphone.

3. The microphone enclosure of claim 1, wherein the solid mass surrounds the microphone in a way such that almost no air is tapped between the plastic mass and the outer surfaces of the microphone.

4. The microphone enclosure of claim 1, wherein the solid mass is a plastic mass shaped to replace an air space around the microphone.

5. The microphone enclosure of claim 1 further comprising a microphone boot placed between the microphone and the solid mass to provide physical stability to the microphone.

6. The microphone enclosure of claim 5, wherein the microphone boot and the microphone enclosure each has an opening through which a microphone wire extends.

7. The microphone enclosure of claim 1, wherein the microphone is placed in the microphone enclosure through the first opening.

8. A microphone enclosure for reducing the intensity of speaker sound waves that are coupled with a microphone wherein the microphone and speaker are connected to a housing, the enclosure comprising a solid mass that isolates the microphone from the mechanical vibrations generated by the sneaker that are propagated through the housing to the microphone and a cavity in the solid mass, the cavity shaped to fit the microphone without covering one or more primary sound receiving sections of the microphone, and wherein the cavity comprises a first section and a second section and a surface of the second section forming an end of the cavity, the first section having a different dimension than the second section so that the size of the cavity is smaller near the end than at the entrance of the cavity.

9. The microphone enclosure of claim 8, wherein the second section is too small to fit the microphone so that when the microphone is inserted into the cavity there is a space between a surface of the microphone deepest into the cavity and the end of the cavity, the space having boundaries defined by the shape and size of the second section.

10. The microphone enclosure of claim 9, wherein the second section of the cavity comprises a microphone opening that allows sound to travel into the space and reach the microphone.

11. The microphone enclosure of claim 8 further comprising a wire hole on a surface of the cavity, the wire hole sized to accommodate a microphone wire extending from the microphone.

12. A communication device comprising a housing, a speaker located inside the housing, and a microphone located inside the housing wherein the microphone is at least partially enclosed in a solid mass enclosure that reduces a mechanical-acoustic coupling of sounds from the speaker to the microphone, and wherein the microphone is placed in a cavity in the solid mass enclosure but does not touch the end of the cavity so that there is a space between the microphone and the end of the cavity wherein the space is at least partly defined by a cavity sidewall, the cavity sidewall having a sidewall opening through which sound can reach the microphone.

13. The communication device of claim 12 further comprising a microphone boot located between the microphone and the solid mass.

14. The communication device of claim 12 wherein the sidewall opening is aligned with a microphone opening on the housing.

15. The communication device of claim 12 wherein a sound-receiving surface of the microphone that is not covered by the solid mass enclosure, the sound-receiving surface being aligned with a microphone opening on the housing.

* * * * *